US006425332B1

(12) United States Patent
Capers et al.

(10) Patent No.: US 6,425,332 B1
(45) Date of Patent: Jul. 30, 2002

(54) LOW-ENERGY SHOCK TUBE CONNECTOR SYSTEM

(75) Inventors: John Capers, McArthur; Goran Jidestig, Athens, both of OH (US)

(73) Assignee: Austin Powder Company, Cleveland, OH (US)

( * ) Notice: Subject to any disclaimer, the term of this patent is extended or adjusted under 35 U.S.C. 154(b) by 0 days.

(21) Appl. No.: 09/933,486

(22) Filed: Aug. 16, 2001

Related U.S. Application Data

(62) Division of application No. 09/260,818, filed on Mar. 2, 1999, now Pat. No. 6,305,287.
(60) Provisional application No. 60/077,427, filed on Mar. 9, 1998.

(51) Int. Cl.[7] ..... F42B 3/00; C06C 5/04

(52) U.S. Cl. ..... 102/318; 102/275.4; 102/275.7; 102/275.8; 102/275.12; 102/331

(58) Field of Search ..... 102/318, 331, 102/275.4, 275.7, 275.8, 275.12

(56) References Cited

U.S. PATENT DOCUMENTS

| | | | | | |
|---|---|---|---|---|---|
| 4,702,168 | A | * | 10/1987 | Colle, Jr. et al. | 102/318 X |
| 4,714,017 | A | * | 12/1987 | Kelly et al. | 102/275.3 |
| 4,718,345 | A | * | 1/1988 | Yunan | 102/316 X |
| 4,821,645 | A | * | 4/1989 | Reiss | 102/275.7 |
| 5,012,741 | A | * | 5/1991 | Peebles et al. | 102/275.4 |
| 5,171,935 | A | * | 12/1992 | Michna et al. | 102/275.7 |
| 5,204,492 | A | * | 4/1993 | Jacob et al. | 102/318 |
| 5,299,500 | A | * | 4/1994 | Lindquist et al. | 102/275.12 |
| 5,398,611 | A | * | 3/1995 | Michna et al. | 102/275.7 |
| 5,423,263 | A | * | 6/1995 | Rontey et al. | 102/275.12 |
| 5,499,581 | A | * | 3/1996 | Sutula, Jr. | 102/275.12 |

* cited by examiner

*Primary Examiner*—Peter A. Nelson
(74) *Attorney, Agent, or Firm*—Fay, Sharpe, Fagan, Minnich & McKee, LLP

(57) ABSTRACT

A shock tube connector system comprises a substantially cylindrical detonator having a longitudinal axis a block body receiving the detonator therein, and an end cap. The detonator includes an axisymmetric exterior shell including a cylindrical main section, a cylindrical explosive end portion having a diameter less than the diameter of the main section, and a transition portion connecting the main section and the explosive end portion of the shell. An explosive charge is contained within the explosive end portion of the shell and is distributed along the longitudinal length of the explosive end portion. The explosive charge preferable comprises two portions of lead azide or a first charge portion of lead azide and PETN and a second charge portion of PETN. An initiating shock tube is operatively connected to the explosive charge via a delay element. The block body includes a housing within which the main section of the detonator is received. A tube holder connected to one end of the housing includes a base member having a bore within which the explosive end portion of the detonator is received. The tube holder is T-shaped and includes a pair of engaging flanges spaced from the base member on laterally opposite sides of the base member to define therebetween pair of engaging slots extending parallel to the longitudinal axis of the detonator and alongside the explosive end of the detonator received in the bore. Each engaging slot is adapted to frictionally grip at least four shock tubes alongside the explosive end of the detonator with the longitudinal axes of the shock tubes substantially orthogonal to the longitudinal axis of the detonator. The end cap is connected to the other end of the housing and secures the detonator within the block body.

22 Claims, 7 Drawing Sheets

LOW-ENERGY SHOCK TUBE CONNECTOR SYSTEM

This application is a divisional of U.S. patent application Ser. No. 09/260,818, filed Mar. 2, 1999 now U.S. Pat. No. 6,305,287 which claims priority from U.S. Provisional Patent Application Ser. No. 60/077,427, filed Mar. 9, 1998.

BACKGROUND OF THE INVENTION

The present invention relates to a system for transmitting an ignition signal from a single detonator to a plurality of transmission lines connected to other detonators for the purpose of producing a predetermined, timed blasting pattern. In particular, the present invention relates to a system for controlling the ignition of a series of non-electrical detonators.

In non-electrical detonation of explosives, signals are transmitted between lengths of detonator cord, known as "shock tubes," by employing connector blocks. A connector block typically includes a detonator receiving the detonation signal from its own shock tube, a housing to contain the explosive effect of the detonator and limit the production of shrapnel, and a mechanism for securing a plurality of shock tubes adjacent the charge within the detonator. Upon ignition of the charge within the detonator, signals are generated within the shock tubes held with the securing mechanism. Examples of conventional detonator blocks include those described in U.S. Pat. No. 5,171,935, U.S. Pat. No. 5,204,492, U.S. Pat. No. 5,423,263, U.S. Pat. No. 5,458,611, and U.S. Pat. No. 5,499,581, U.S. Pat. No. 5,703,319, and U.S. Pat. No. 5,792,975, which are incorporated herein by reference.

Conventional shock tube connector systems are limited in a number of ways. For example, they generally can hold a maximum of four to six shock tubes, which limits the number of circuits that can be initiated from a given connector block. Moreover, most connector blocks create a variety of spatial relationships between the explosive charge within the detonator and the several shock tubes held by the block, which often results in inconsistent signal transmission to the individual shock tubes. In addition, to the extent more powerfull detonator charges are employed to ensure adequate signal transmission to all shock tubes, not only does the cost of the system increase, but increased shrapnel may result.

It is the intention of this invention to provide a connector block that can hold up to eight shock tubes and effect signal transmission between the detonator and all eight shock tubes.

It also is the intention of this invention to provide a shock tube connector system that utilizes a modified detonator to transmit detonation signals efficiently and consistently to a plurality of shock tubes.

Additional advantages of the present invention will be set forth in part in the description that follows, and in part will be obvious from that description or can be learned by practice of the invention. The advantages of the invention can be realized and obtained by the apparatus particularly pointed out in the appended claims.

SUMMARY OF THE INVENTION

The present invention overcomes the problems of prior art shock tube connector systems and accomplishes its purpose by providing a mechanism to secure up to four shock tubes in each of two parallel rows positioned on laterally opposite sides of the explosive end of a detonator so that the longitudinal axes of the shock tubes are substantially orthogonal to the longitudinal axis of the detonator. The explosive end of the detonator preferably has a reduced diameter and extended length and has an explosive charge distributed longitudinally within it to provide the appropriate energy blast to the rows of shock tubes.

To overcome the problems of the prior art shock tube connector systems, and in accordance with the purpose of the invention, as embodied and broadly described herein, the connector block of this invention is for transmitting a detonation signal to one or more shock tubes from a detonator having a longitudinal axis and an explosive end portion containing an explosive charge and comprises a housing having a first end and a second end and a tube holder connected to the first end of the housing. The housing is adapted to receive a detonator therein with the explosive end of the detonator disposed adjacent the first end of the housing. The tube holder includes at least one engaging slot extending parallel to the longitudinal axis of the detonator and alongside the explosive end of the detonator when the detonator is received in the housing. The engaging slot is adapted to frictionally grip at least four shock tubes alongside the explosive end of the detonator with the longitudinal axes of the shock tubes substantially orthogonal to the longitudinal axis of the detonator.

Preferably, the tube holder includes a base member having one end connected to the first end of the housing with a bore adapted to receive the explosive end of the detonator therein, a cross member connected to the distal end of the base member and extending substantially orthogonally with respect to the longitudinal axis of the detonator, and a pair of engaging flanges depending from the cross member and extending toward the housing on substantially laterally opposite sides of the base member. Each of the engaging flanges is spaced from the base member to define between the respective engaging flange and the base member an engaging slot, and each of the engaging slots is adapted to frictionally grip a plurality of shock tubes alongside the explosive end of the detonator with the longitudinal axes of the shock tubes substantially orthogonal to the longitudinal axis of the detonator.

In another aspect of the invention, the shock tube connector system comprises a substantially cylindrical detonator having a longitudinal axis, a block body receiving the detonator therein, and an end cap. The detonator includes an exterior shell including a cylindrical main section, a cylindrical explosive end portion having a diameter less than the diameter of the main section, and a transition portion connecting the main section and the explosive end portion of the shell. The shell is substantially axisymmetric with respect to the longitudinal axis of the detonator, and the main section has a signal end longitudinally opposite the explosive end portion. An explosive charge is contained within the explosive end portion of the shell and is distributed along the longitudinal length of the explosive end portion. An initiating shock tube is operatively connected to the explosive charge. The initiating shock tube enters the detonator at the signal end of the main section of the shell and is adapted to transmit an ignition signal to the detonator causing the explosive charge to ignite. The block body includes a housing having a first end and a second end, with the main section of the detonator being received within the housing and the explosive end portion of the detonator extending beyond the first end of the housing. A tube holder is connected to the first end of the housing. The tube holder includes a base member having a bore, with the explosive end portion of the detonator being received within the bore. The tube holder includes at least one engaging flange spaced from the base member, with the base member and the engaging flange defining therebetween an engaging slot extending parallel to the longitudinal axis of the detonator and alongside the explosive end of the detonator received in the bore. The engaging slot is adapted to frictionally grip a plurality of shock tubes alongside the explosive end of the detonator with the longitudinal axes of the shock tubes substantially orthogonal to the longitudinal axis of the detonator. The end cap is connected to the second end of the housing and secures the detonator within the block body.

The accompanying drawings, which are incorporated in and which constitute a part of this specification, illustrate at least one embodiment of the invention and, together with the description, explain the principles of the invention.

DESCRIPTION OF THE INVENTION

Reference now will be made in detail to the presently preferred embodiments of the invention, examples of which are illustrated in the accompanying drawings.

Figure 1A:
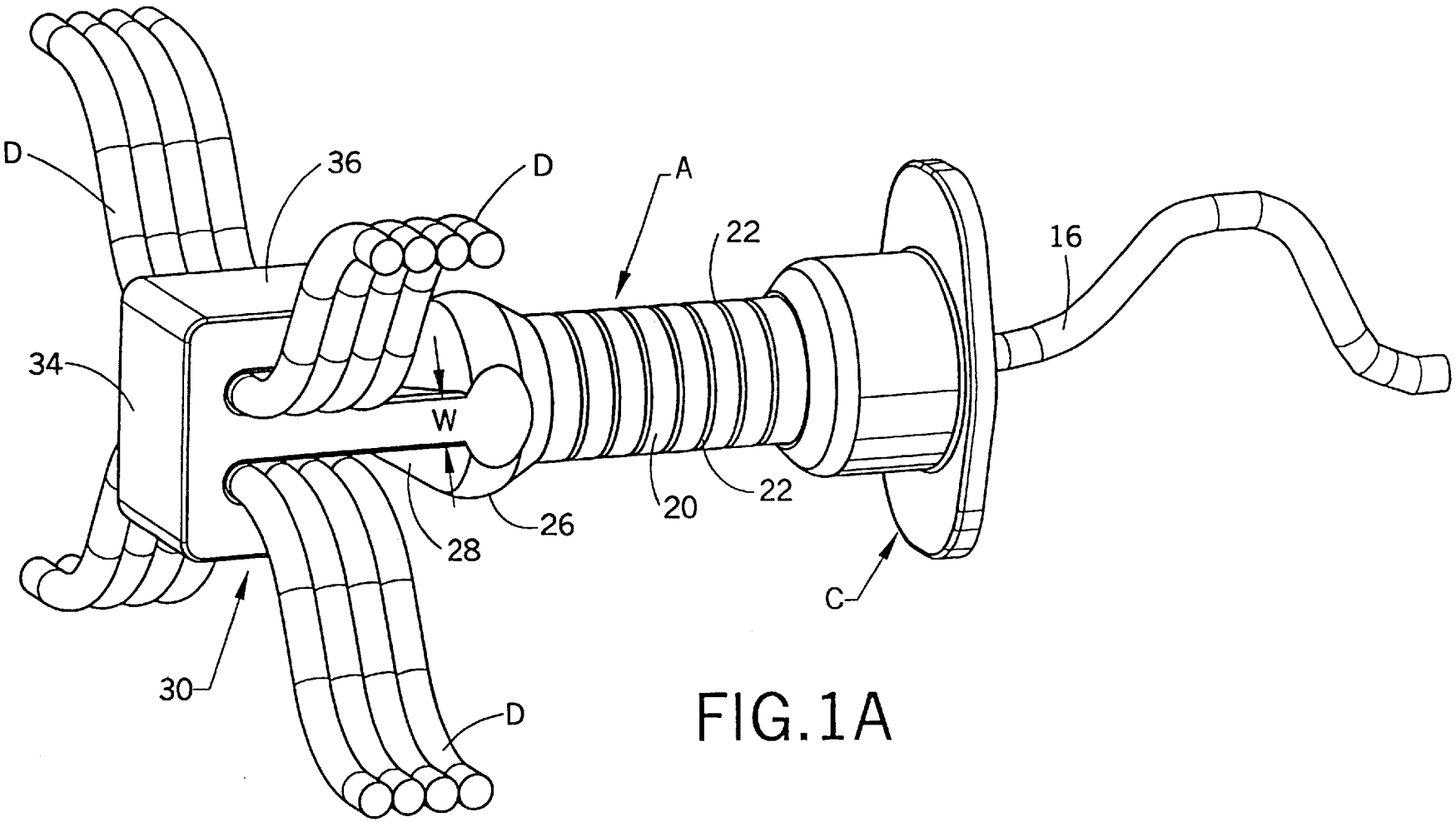
FIGS. 1A and 1B are perspective views of the shock tube connector system of this invention holding eight shock tubes.
Figure 1B:
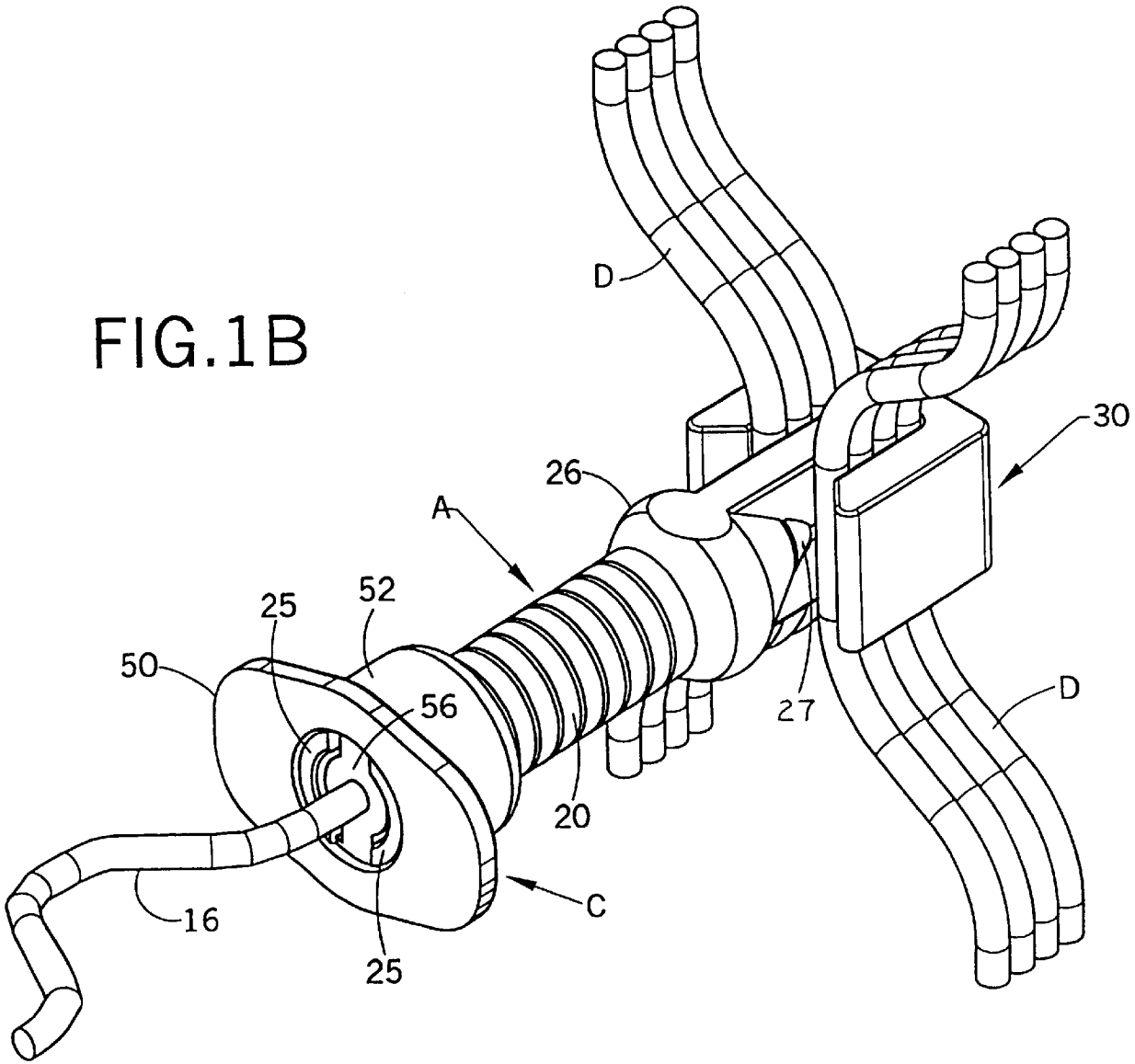
Figure 1C:
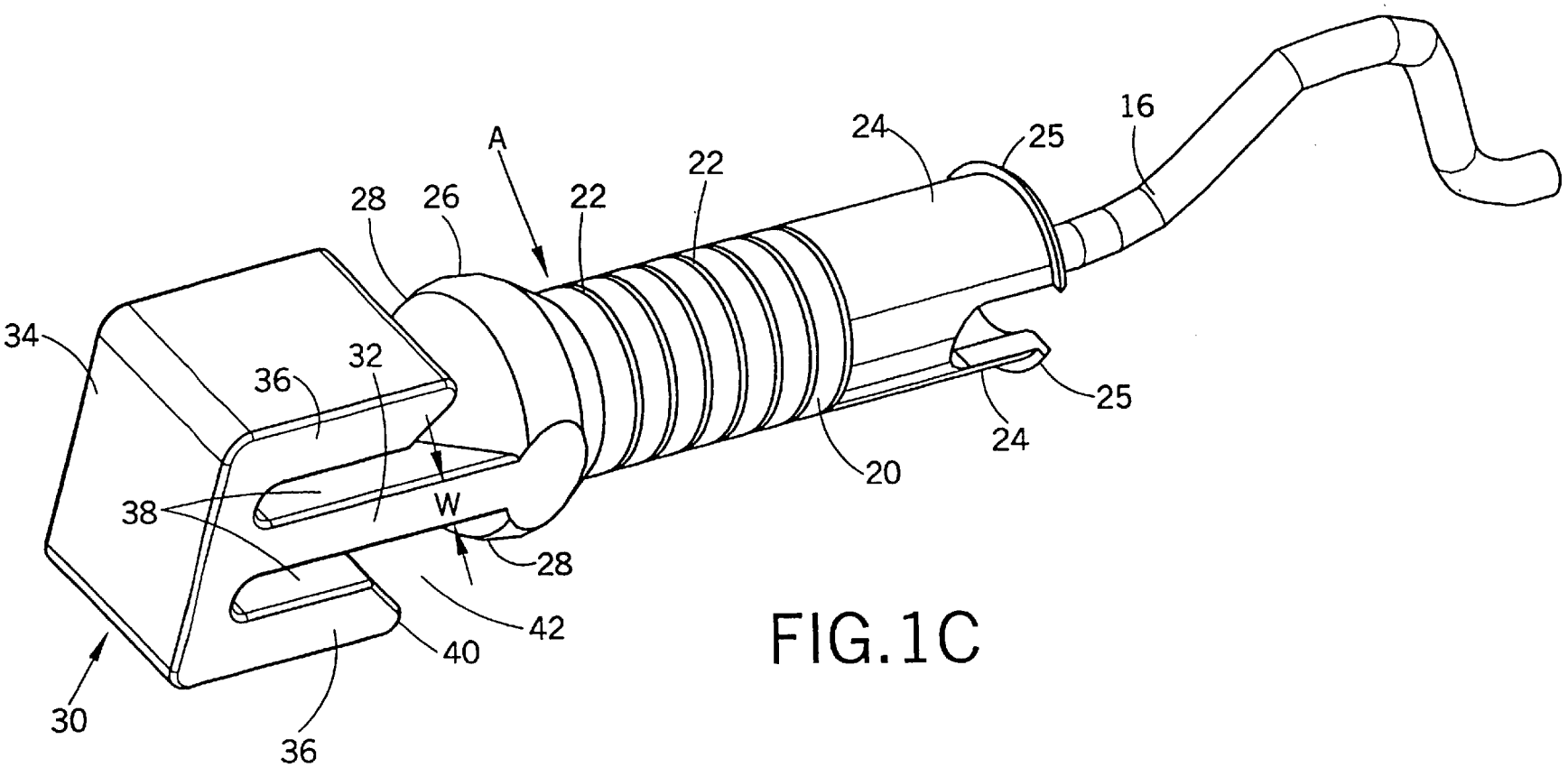
FIGS. 1C and 1D are perspective views of the shock tube connector system of this invention with the end cap removed.
Figure 1D:
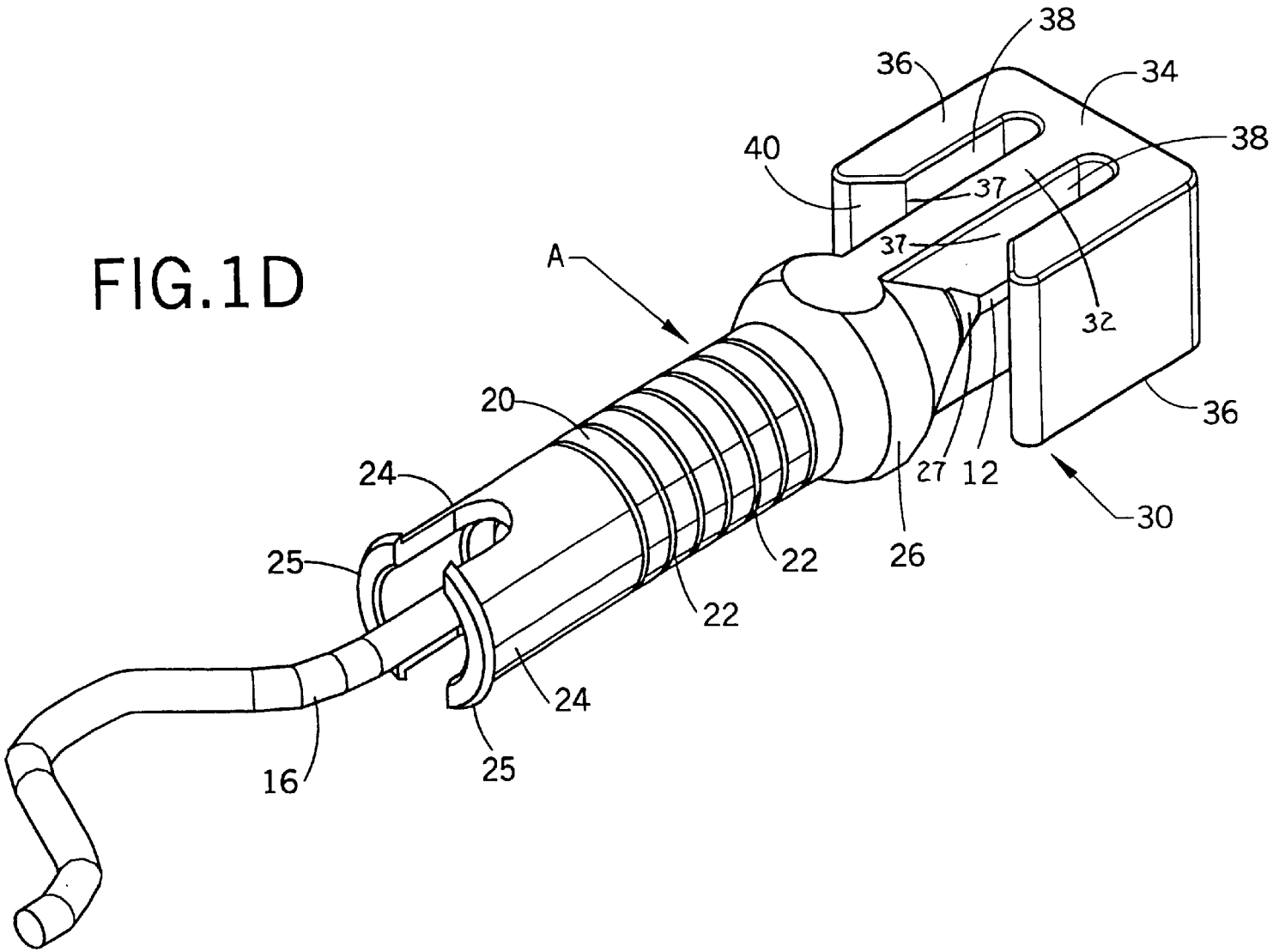
Figure 1E:
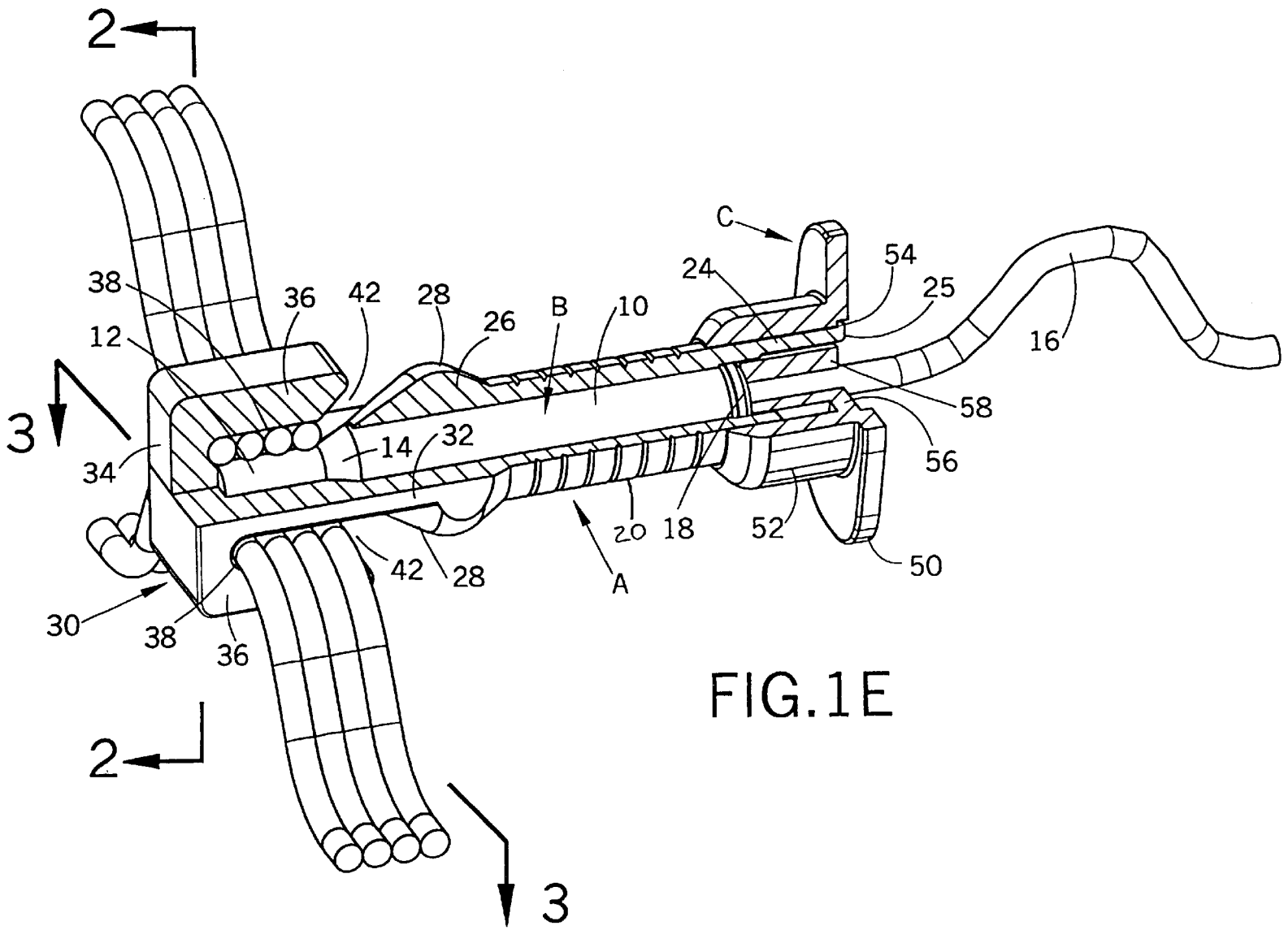
FIG. 1E is a perspective view of the shock tube connector system of this invention partially cut away to show the detonator contained within.
Figure 2:
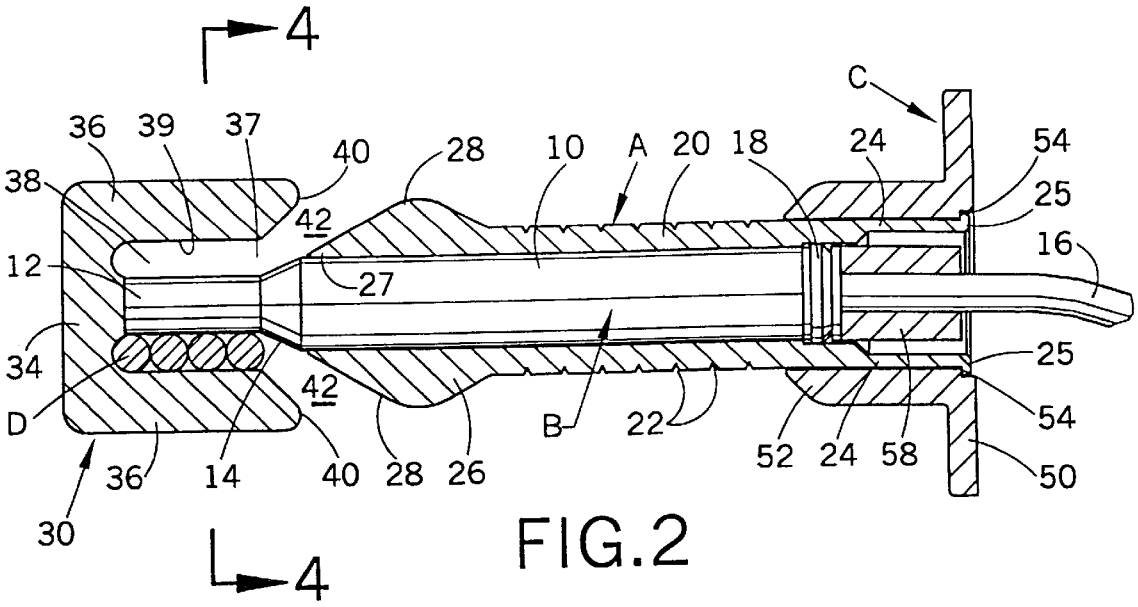
FIG. 2 is a cross-sectional view of the shock tube connector system of this invention taken along line 2—2 of FIG. 1E and showing four shock tubes held on one side of the connector.
Figure 3:
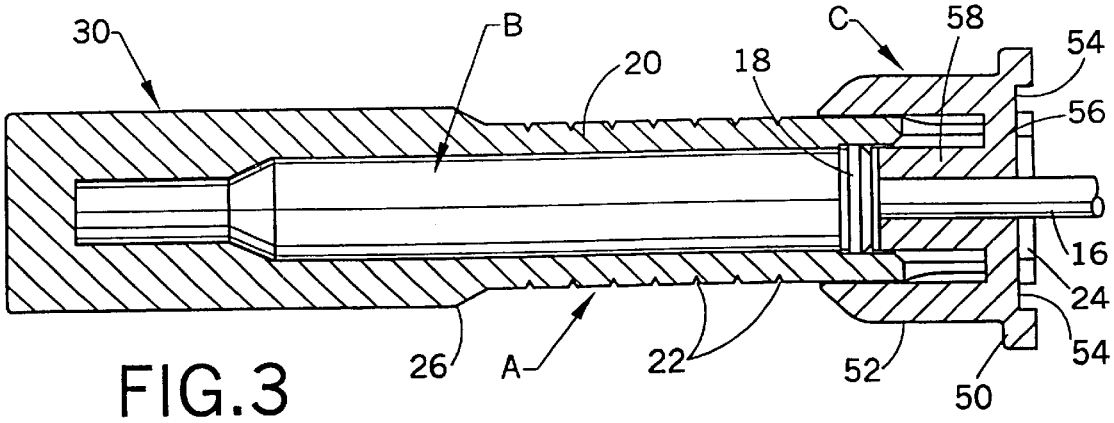
FIG. 3 is a cross-sectional view of the shock tube connector system of this invention taken along line 3—3 of FIG. 1E.
Figure 4:
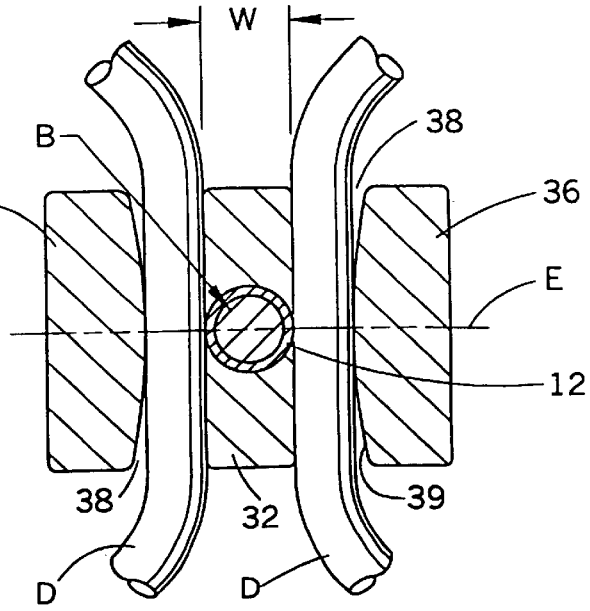
FIG. 4 is a cross-sectional view of the shock tube connector system of this invention taken along line 4—4 of FIG. 2, showing two shock tubes held in place by the connector.

As shown generally in FIGS. 1A–1E and in the cross-sectional views of FIGS. 2–4, the shock tube connector system of this invention comprises block body A, detonator B, and end cap C. Detonator B is held within block body A and secured in position by end cap C. Block body A and end cap C together comprise a connector block and preferably are formed by injection molding techniques from polyethylene, polypropylene, or a combination thereof As shown in FIGS. 1A, 1B, 2, and 4, a plurality of shock tubes D are held in place by the connector of this invention.

Figure 5:
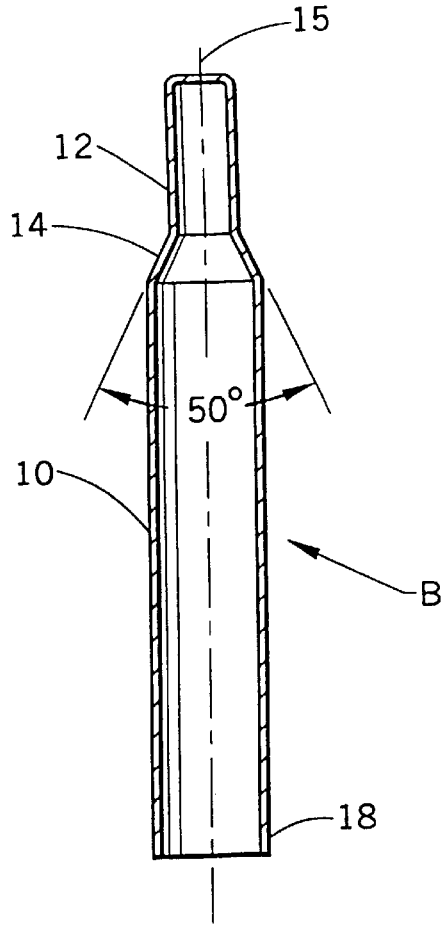
FIG. 5 is a cross-sectional view of the shell of the detonator of the shock tube connector system of this invention.

Detonator B is a generally cylindrical metallic shell of circular cross section preferably formed from aluminum about 0.5 mm thick and shaped as shown in FIG. 5. The detonator is comprised of a main cylindrical section 10, a smaller-diameter cylindrical explosive end portion 12, and a transition portion 14. The shell of detonator B preferably is axisymmetric with respect to its longitudinal axis 15. The main explosive charge of detonator B is located in explosive end portion 12 and is distributed along the axial length of end portion 12 so that the explosive force of the ignited main charge will ignite the shock tubes D held in place alongside end portion 12. An initiating shock tube 16 connected to the opposite signal end 18 of detonator B (see FIGS. 1E, 2, and 3) provides the ignition signal to ignite the main charge within explosive end portion 12. In the presently preferred embodiment, main cylindrical section 10 has an outer diameter of about 7.5 mm; explosive end portion 12 is about 9–15 mm in axial length, most preferably 11 mm, and has an outer diameter of about 3–5 mm, most preferably about 4.2 mm; and transition portion 14 accomplishes the reduction in shell diameter over an axial length of about 4 mm. The angle between opposite sides of the transition portion 14 preferably is about 50°.

Block body A includes housing 20, which has a cylindrical bore sized to accommodate main cylindrical section 10 of detonator B. Housing 20 preferably has a circular cross section over most of its length, with grooves 22 formed in its surface to assist the user in gripping the connector. A pair of prongs 24, each with a locking tab 25, are formed at one end of housing 20 for engaging with end cap C. A pear-shaped enlarged portion 26 is formed at the other end 27 of housing 20. The distal end of pear-shaped enlarged portion 26 includes a pair of surfaces 28 that converge toward one another. Preferably, converging surfaces 28 are defined by a frustum of a cone.

Connected to end 27 of housing 20 (at the distal end of enlarged portion 26) is means for securing a plurality of shock tubes in proximity to the explosive end portion of the detonator, that is, adjacent the detonator's main charge. The securing means of this invention, shown in the perspective views of FIGS. 1A–1E, comprises a T-shaped tube holder 30 that includes base member 32 connected to enlarged portion 26 of housing 20, cross member 34 intersecting base member 32 orthogonally, and a pair of engaging flanges 36 depending from the lateral ends of cross member 34 and extending back toward main housing section 20. Each engaging flange 36 is disposed substantially parallel to base member 32 and is spaced therefrom to define an engaging slot 38 on each lateral side of base member 32. Each engaging slot 38 has an entry opening 37 adjacent end 27 of housing 20 to permit placement of shock tubes D therein.

Each engaging slot 38 should be less than 3 mm in width, preferably about 2.9 mm, to permit shock tubes of nominal 3 mm diameter to be frictionally gripped by the surfaces of base member 32 and engaging flange 36 facing the slot. The engaging slot preferably is at least about 12 mm in length (parallel to the longitudinal axes of housing 20 and detonator B) to permit at least four shock tubes D to be held in each slot with the longitudinal axes of the tubes orthogonal to the longitudinal axis of the detonator (see FIG. 2, showing four shock tubes held in one of the engaging slots 38. The gripping surfaces 39 of engaging flanges 36 that face engaging slots 38 preferably have a slightly convex shape, as shown in FIG. 4, and provide maximum gripping of shock tubes D adjacent plane E passing through the lateral center of block body A. Furthermore, a ridge (not shown) can-be provided in the lengthwise direction of engaging slot 38 (into the plane of FIG. 4) on the gripping surface 39 of engaging flange 36, preferably where it intersects with plane E, to provide additional frictional securement of the shock tubes within engaging slot 38.

Base member 32 includes a cylindrical bore dimensioned to accommodate explosive end portion 12 of detonator B. The width W of base member 32 preferably is less than the diameter of explosive end portion 12 of detonator B at the bore within base member 32, so that the bore is exposed to slots 38 (as shown in FIGS. 1C and 1D), and the end portion 12 extends laterally into slots 38. For example, W preferably is about 4 mm at the bore when the outer diameter of end portion 12 is 4.2 mm. As a consequence, shock tubes D are gripped between the exposed detonator end portion and the adjacent engaging flange 36. The thickness of base member 32 (orthogonal to width W in the plane of FIG. 4) is substantially greater than width W, preferably about 15–25 mm and most preferably about 20 mm, to provide containment of shrapnel upon the ignition of detonator B and assist in directing the explosive force of detonation toward the engaging slots. If desired, the width W of base member 32 can be increased away from the bore area to provide additional strength. Each engaging flange 36 preferably is about 5–7 mm wide and most preferably about 6 mm (measured in the same direction as width W) and about 15–20 mm thick, most preferably 17 mm. The engaging flanges also assist in shrapnel containment.

The terminal ends 40 of engaging flanges 36 preferably are substantially planar surfaces spaced from the adjacent surfaces 28 of enlarged portion 26 to define converging entrance slots 42 that communicate with entry openings 37 of engaging slots 38. The spacing within each entrance slot 42 preferably varies from about 4 mm at its widest to about 1.5–2.5 mm, most preferably about 2.0 mm, at the entry opening 37. Because this smaller dimension is less than the nominal diameter of a standard shock tube, the user should sense resistance to the insertion of a shock tube into either of engaging slots 38.

End cap C preferably has a hat-shaped exterior comprising a flange 50 and a sleeve member 52. End cap C also includes a circular ledge 54, recessed from the flange 50, that engages with locking tabs 25 to secure the end cap in place. Preferably, a cross member 56 spans ledge 54 and supports cylindrical spacer 58, which is sized to contact with the signal end 18 of detonator B when the latter is encompassed within block body A and ensure that detonator B is inserted fully into block body A. Spacer 58 includes an axial bore to allow shock tube 16 attached to detonator B to pass out of the block body. The configuration of end cap C disclosed herein provides a secure engagement of the end cap with block body A. Other configurations may be used where it is desirable to provide an end cap that is easier to disengage.

Typical methods for loading explosive charges in detonators must be modified when using detonator B of this invention with the reduced diameter at its end portion. In the preferred method of loading the detonator, a number (typically one hundred) of empty shells first are placed in a holder with the end portion 12 directed downwardly. Then the end portion of each of the shells is loaded with the main charge, preferably by a volumetric dosing process in which predetermined fractions of the charge are loaded into the shell. Where an intermediate compression step is desired for a given fraction, compression of the charge fraction preferably is performed with press pins using a hydraulic press.

Figure 6:
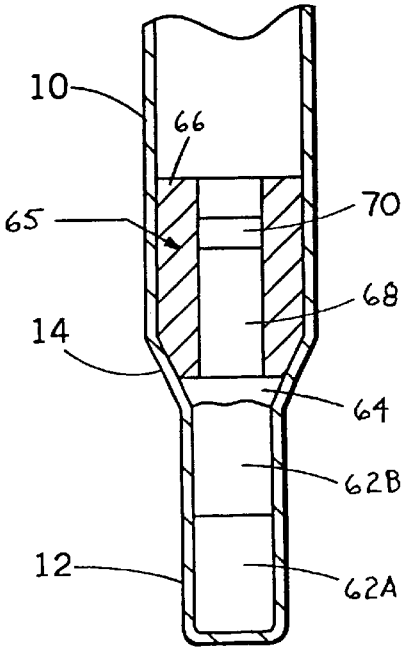
FIG. 6 is a cross-sectional view of one embodiment of the explosive end portion of the detonator of the shock tube connector system of this invention.

In one embodiment of the detonator of this invention, shown in FIG. 6, the main charge consists of lead azide that is dextrinated to make it less sensitive to detonation when undergoing compression during this loading process. The charge is loaded in two steps, each requiring the supply of approximately one half the total charge. Initially, a first main charge portion 62A of dextrinated lead azide is loaded into the end portion 12 and the charge portion is pressed using a force between 100N and 3000N per detonator, most preferably less than 1000N. A second main charge portion 62B of dextrinated lead azide then is loaded on top of first portion 62A. The total amount of dextrinated lead azide in the main charge of this first embodiment preferably is 175–240 mg, most preferably 210 mg loaded in two dosages of 105 mg each. If desired, a thin layer of PETN (approximately 20 mg) can be loaded on top of first portion 62A prior to pressing to help guard against the lead azide detonating during compaction. In addition, the main charge can be loaded in more than two dosages.

To protect against explosion of the charges during subsequent loading operations, a small, fast-burning pyrotechnic charge 64, preferably about 50 mg of a zirconium/red lead mixture, then is placed on top of the main lead azide charge. A delay element 65 then is inserted into the shell and is compressed on top of the main charge with press pins operated by a hydraulic press. Press force for this step of the operation preferably is between 300 N and 3000 N per detonator. The delay element preferably comprises a delay tube 66 filled with a charge 68 of delay powder, such as a silicon/red lead mixture, and has a predetermined height within main cylindrical section 10 of detonator B associated with the desired time delay. The inside diameter of delay tube 66 preferably is about 3 mm, and delay tube 66 preferably is formed from steel, aluminum, or zincalloy. The delay element typically provides a relatively tight fit with the inner diameter of the detonator shell and, in this instance, preferably has a frusto-conical end to complement the transition portion 14 of the detonator. If desired, a starter charge 70 can be pressed on top of the delay powder 68 to transfer the ignition pulse from the initiating shock tube to the delay powder. Finally, the detonator's initiating shock tube is connected to delay element 65 in accordance with conventional practice.

Figure 7:
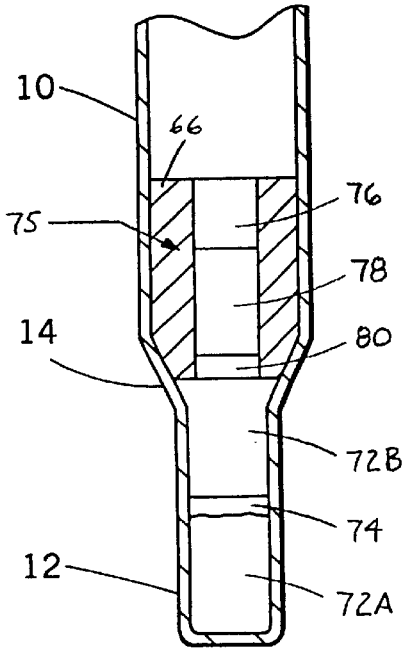
FIG. 7 is a cross-sectional view of a second embodiment of the explosive end portion of the detonator of the shock tube connector system of this invention.

In an alternative embodiment, shown in FIG. 7, the main charge comprises a first main charge portion 72A of about 100 mg of dextrinated lead azide followed by a thin layer 74 of about 20 mg of PETN to protect the lead azide during subsequent compression. This material then is pressed with a pressing force of about 700N to a height of about 5 mm. A second main charge portion 72B of about 55 mg of PETN is then loaded but not pressed. The second embodiment of the detonator for this invention also includes a delay element 75, which preferably is formed by filling delay tube 66 with a dose 80 of delay powder, such as a silicon/red lead mixture, up to about 5 mm short of the conical end (using, e.g., pins inserted in the conical end to provide the desired clearance). Delay tube 66 then is turned conical end up and is filled with a charge 78 of about 50 mg of dextrinated lead azide and an charge 80 of about 35 mg of inert powder, such as talc or a delay powder substance. The lead azide charge 78 and inert powder charge 80 then are compressed with a pressing force preferably about 700N. Finally, the delay element 75 is inserted in the shell in a manner similar to that described above with respect to delay element 65 (preferably without compressing the PETN of second main charge portion 72B), and the detonator's initiating shock tube is connected to delay element 75 in accordance with conventional practice. If desired, a starter charge (not shown) can be loaded on top of delay element 75.

The detonation/signal transmission system of this invention, as described above, differs from that of conventional shock tube connector blocks, which employ a detonator having a main charge disposed at its extreme end and configured to ignite longitudinally out of the detonator end to transmit the ignition signal to shock tubes positioned at the extreme end. The system of this invention employs a detonator having a main charge disposed along a preselected axial length and configured to ignite laterally in order to transmit the ignition signal to shock tubes arranged alongside the main charge. The configuration of the connector block of this invention increases the effective length over which the detonator's ignition signal can be transmitted and, accordingly, increases the number of shock tubes that can be ignited by a single detonator. Other explosive substances, such as lead styphnate, DDNP, or mixtures thereof can be used instead of lead azide as the primary explosive charge within explosive end portion 14, and RDX, HMX, Tetryl, TNT, or mixtures thereof can be used in place of the PETN in the embodiments described above. Irrespective of which explosive compounds are used, however, the energy of the main charge within end portion 12 should be as low as practicable while reliably initiating up to four pairs of adjacent shock tubes. The reduced diameter of end portion 12 is a result of minimizing the size of the main charge and distributing the charge longitudinally.

It will be apparent to those skilled in the art that additional modifications and variations can be made in the disclosed connector block, detonator, and shock tube connector system without departing from the scope of the invention. For example, the tube holder can be rotated by 180° so that it is fork-shaped, with the cross member connecting the engagement flanges to the base member adjacent the enlarged portion of the housing and the entry openings of the engagement slots being disposed at the extreme end of the connector block opposite the end cap. The invention in its broader aspects is, therefore, not limited to the specific details and illustrated examples shown and described. Accordingly, it is intended that the present invention cover such modifications and variations provided that they fall within the scope of the appended claims and their equivalents.

We claim:

1. A shock tube connector system for transmitting a detonation signal to one or more shock tubes, comprising:

a. a substantially cylindrical detonator having a longitudinal axis, said detonator including:

an elongated exterior shell including a main section and an explosive end portion at one longitudinal end of said main section, and an explosive charge contained within said explosive end portion of said shell, said explosive charge being distributed along the longitudinal length of said explosive end portion, whereby ignition of said explosive charge produces a laterally directed explosive force; and b. a block body including:

a housing having a first end and a second end, said detonator being received in said housing with said explosive end of said detonator disposed adjacent said first end of said housing, and a tube holder connected to said first end of said housing, said tube holder including at least one engaging slot extending parallel to said longitudinal axis of said detonator and alongside said explosive end of said detonator received in said housing, said engaging slot being adapted to grip at least four shock tubes alongside said explosive end of said detonator with the longitudinal axes of the shock tubes substantially orthogonal to said longitudinal axis of said detonator.

2. A shock tube connector system for transmitting a detonation signal to one or more shock tubes, comprising:

a. a substantially cylindrical detonator having a longitudinal axis, said detonator including:

an elongated exterior shell including a main section and an explosive end portion at one longitudinal end of said main section, an explosive charge contained within said explosive end portion of said shell, said explosive charge being distributed along the longitudinal length of said explosive end portion, whereby ignition of said explosive charge produces a laterally directed explosive force; and b. a block body including:

a housing having a first end and a second end, said detonator being received within said housing with said explosive end portion of said detonator disposed adjacent said first end of said housing, and a tube holder connected to said first end of said housing, said tube holder including a base member having a bore, said explosive end portion of said detonator being received within said bore, said tube holder including at least one engaging flange connected to and spaced from said base member, said base member and said engaging flange defining therebetween an engaging slot extending parallel to said longitudinal axis of said detonator and alongside said explosive end of said detonator received in said bore, said engaging slot being adapted to frictionally grip a plurality of shock tubes alongside said explosive end of said detonator with the longitudinal axes of the shock tubes substantially orthogonal to said longitudinal axis of said detonator.

3. The connector block of claim 2, wherein said base member of said tube holder has a thickness substantially greater than the diameter of the explosive end of the detonator and a width substantially less than said thickness of said base member.

4. The connector block of claim 3, wherein said bore of said base member has a diameter greater than said width of said base member measured at said bore, whereby said bore opens into said engaging slot and permits direct contact between the explosive end of the detonator and the one or more shock tubes gripped in said engaging slot.

5. The connector block of claim 2, wherein said engaging slot has a length of at least about 12 mm.

6. The connector block of claim 2, wherein said base member has a width of about 4 mm at said bore and a thickness of about 15–25 mm.

7. The connector block of claim 2, wherein said base member has a width of about 4 mmn at said bore and a thickness of about 20 mm.

8. The connector block of claim 2, wherein said engaging flange has a width of about 5–7 mm and a thickness of about 15–20 mm.

9. The connector block of claim 2, wherein said engaging flange has a width of about 6 mm and a thickness of about 17 mm.

10. The connector block of claim 2, wherein said engaging flange includes a convex gripping surface facing said engaging slot.

11. The connector block of claim 2, wherein said engaging flange includes a gripping surface facing said engaging slot and a ridge projecting from said gripping surface into said engaging slot.

12. A shock tube connector system for transmitting a detonation signal to one or more shock tubes, comprising:

a. a substantially cylindrical detonator having a longitudinal axis, said detonator including:

an elongated exterior shell including a main section and an explosive end portion at one longitudinal end of said main section, said main section having a signal end longitudinally opposite said explosive end portion, an explosive charge contained within said explosive end portion of said shell, said explosive charge being distributed along the longitudinal length of said explosive end portion, whereby ignition of said explosive charge produces a laterally directed explosive force, and an initiating shock tube operatively connected to said explosive charge, said initiating shock tube entering said detonator at said signal end of said main section of said shell and being adapted to transmit an ignition signal to said detonator causing said explosive charge to ignite; and b. a block body including:

a housing having a first end and a second end, said main section of said detonator being received within said housing and said explosive end portion of said detonator extending beyond said first end of said housing, and a tube holder connected to said first end of said housing, said tube holder including a base member having a bore, said explosive end portion of said detonator being received within said bore, said tube holder including at least one engaging flange spaced from said base member, said base member and said engaging flange defining therebetween an engaging slot extending parallel to said longitudinal axis of said detonator and alongside said explosive end of said detonator received in said bore, said engaging slot being adapted to frictionally grip a plurality of shock tubes alongside said explosive end of said detonator with the longitudinal axes of the shock tubes substantially orthogonal to said longitudinal axis of said detonator.

13. The shock tube connector system of claim 12, further comprising:

c. an end cap connected to said second end of said housing, said end cap securing said detonator within said block body.

14. The shock tube connector system of claim 12, wherein said engaging slot has a length sufficient to grip at least four shock tubes.

15. A shock tube connector system, comprising:

a. a substantially cylindrical detonator having a longitudinal axis, said detonator including:

an elongated exterior shell including a main section and an explosive end portion at one longitudinal end of said main section, said main section having a signal end longitudinally opposite said explosive end portion, an explosive charge contained within said explosive end portion of said shell, said explosive charge being distributed along the longitudinal length of said explosive end portion, whereby ignition of said explosive charge produces a laterally directed explosive force, and an initiating shock tube operatively connected to said explosive charge, said initiating shock tube entering said detonator at said signal end of said main section of said shell and being adapted to transmit an ignition signal to said detonator causing said explosive charge to ignite; and b. a block body including:

a housing having a first end and a second end, said main section of said detonator being received within said housing and said explosive end portion of said detonator extending beyond said first end of said housing, and a tube holder connected to said first end of said housing, said tube holder including:

a base member having a bore, said explosive end of said detonator being received within said bore, said base member having one end connected to said first end of said housing and a distal end, and a pair of engaging flanges disposed on substantially laterally opposite sides of said base member, each of said engaging flanges being spaced from said base member to define between said respective engaging flange and said base member an engaging slot extending parallel to said longitudinal axis of said detonator and alongside said explosive end of said detonator, each of said engaging slots being adapted to frictionally grip a plurality of shock tubes alongside said explosive end of said detonator with the longitudinal axes of the shock tubes substantially orthogonal to said longitudinal axis of said detonator.

16. The shock tube connector system of claim 15, further comprising:

c. an end cap connected to said second end of said housing, said end cap securing said detonator within said block body.

17. The shock tube connector system of claim 15, wherein each of said engaging slots has a length sufficient to grip at least four shock tubes.

18. The shock tube connector system of claim 15, wherein said tube holder is substantially T-shaped and includes a cross member connecting said base member to said engaging flanges.

19. The shock tube connector system of claim 5, wherein said tube holder is substantially fork-shaped and includes a cross member connecting said base member to said engaging flanges adjacent said first end of said housing.

20. A shock tube connector system, comprising:

a. a substantially cylindrical detonator having a longitudinal axis, said detonator including:

an exterior shell, said shell including a cylindrical main section, a cylindrical explosive end portion having a diameter less than the diameter of said main section, and a transition portion connecting said main section and said explosive end portion of said shell, said shell being substantially axisymmetric with respect to said longitudinal axis of said detonator, and said main section having a signal end longitudinally opposite said explosive end portion, an explosive charge contained within said explosive end portion of said shell, said explosive charge being distributed along the longitudinal length of said explosive end portion, and an initiating shock tube operatively connected to said explosive charge, said initiating shock tube entering said detonator at said signal end of said main section of said shell and being adapted to transmit an ignition signal to said detonator causing said explosive charge to ignite;

b. a block body including:

a housing having a first end and a second end, said main section of said detonator being received within said housing and said explosive end portion of said detonator extending beyond said first end of said housing, and a tube holder connected to said first end of said housing, said tube holder including a base member having a bore, said explosive end portion of said detonator being received within said bore, said tube holder including at least one engaging flange spaced from said base member, said base member and said engaging flange defining therebetween an engaging slot extending parallel to said longitudinal axis of said detonator and alongside said explosive end of said detonator received in said bore, said engaging slot being adapted to frictionally grip a plurality of shock tubes alongside said explosive end of said detonator with the longitudinal axes of the shock tubes substantially orthogonal to said longitudinal axis of said detonator; and c. an end cap connected to said second end of said housing, said end cap securing said detonator within said block body.

21. The shock tube connector system of claim 20, wherein said engaging slot has a length sufficient to grip at least four shock tubes.

22. A shock tube connector system, comprising:

a. a substantially cylindrical detonator having a longitudinal axis, said detonator including:

an exterior shell, said shell including a cylindrical main section, a cylindrical explosive end portion having a diameter less than the diameter of said main section, and a transition portion connecting said main section and said explosive end portion of said shell, said shell being substantially axisymmetric with respect to said longitudinal axis of said detonator, and said main section having a signal end longitudinally opposite said explosive end portion, an explosive charge contained within said explosive end portion of said shell, said explosive charge being distributed along the longitudinal length of said explosive end portion, and an initiating shock tube operatively connected to said explosive charge, said initiating shock tube entering said detonator at said signal end of said main section of said shell and being adapted to transmit an ignition signal to said detonator causing said explosive charge to ignite;

b. a block body including:

a housing having a first end and a second end, said main section of said detonator being received within said housing and said explosive end portion of said detonator extending beyond said first end of said housing, and a tube holder connected to said first end of said housing, said tube holder including:

a base member having a bore, said explosive end of said detonator being received within said bore, said base member having one end connected to said first end of said housing and a distal end, a cross member connected to said distal end of said base member and extending substantially orthogonally with respect to said longitudinal axis of said detonator, and a pair of engaging flanges depending from said cross member and extending toward said housing on substantially laterally opposite sides of said base member, each of said engaging flanges being spaced from said base member to define between said respective engaging flange and said base member an engaging slot, each of said engaging slots being adapted to frictionally grip a plurality of shock tubes alongside said explosive end of said detonator with the longitudinal axes of the shock tubes substantially orthogonal to said longitudinal axis of said detonator; and c. an end cap connected to said second end of said housing, said end cap securing said detonator within said block body.

* * * * *